US009959855B2

(12) United States Patent
Song et al.

(10) Patent No.: US 9,959,855 B2
(45) Date of Patent: May 1, 2018

(54) SOUND WAVE METAMATERIAL

(71) Applicant: KOREA INSTITUTE OF MACHINERY & MATERIALS, Daejeon (KR)

(72) Inventors: Kyungjun Song, Daejeon (KR); Shin Hur, Daejeon (KR); Youngdo Jung, Seoul (KR); Seong-Hyun Lee, Daejeon (KR); Jedo Kim, Busan (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 0 days. days.

(21) Appl. No.: 15/121,985

(22) PCT Filed: Jul. 28, 2014

(86) PCT No.: PCT/KR2014/006857
§ 371 (c)(1),
(2) Date: Aug. 26, 2016

(87) PCT Pub. No.: WO2015/129969
PCT Pub. Date: Sep. 3, 2015

(65) Prior Publication Data

US 2017/0069303 A1 Mar. 9, 2017

(30) Foreign Application Priority Data

Feb. 28, 2014 (KR) ..... 10-2014-0023953

(51) Int. Cl.
*G10K 11/08* (2006.01)
*G10K 11/22* (2006.01)
(Continued)

(52) U.S. Cl.
CPC ..... *G10K 11/08* (2013.01); *G10K 11/22* (2013.01); *G10K 11/26* (2013.01); *H04R 1/345* (2013.01)

(58) Field of Classification Search
CPC ..... G10K 11/08; G10K 11/22; G10K 11/26
(Continued)

(56) References Cited

U.S. PATENT DOCUMENTS 5,400,171 A 3/1995 Song
5,524,062 A 6/1996 Oh
(Continued)

FOREIGN PATENT DOCUMENTS

JP 2007288688 A 11/2007
KR 960011026 B1 8/1996
(Continued)

OTHER PUBLICATIONS

Choi, Muhan et al., "A terahertz metamaterial with unnaturally high refractive index", Nature, Feb. 17, 2011, pp. 369-374, vol. 470, Macmillan Publishers Limited.
(Continued)

*Primary Examiner* — Jeremy Luks
(74) *Attorney, Agent, or Firm* — Hauptman Ham, LLP

(57) ABSTRACT

A sound wave metamaterial amplifies a sound wave, and includes a plate. The plate has a plurality of sound wave guides passing through both surfaces of the plate and having a predetermined pattern. The sound wave guides are spaced apart from each other by a predetermined distance and face each other, with respect to a central point, a central axis or a central surface.

10 Claims, 8 Drawing Sheets

(51) Int. Cl.
*G10K 11/26* (2006.01)
*H04R 1/34* (2006.01)

(58) Field of Classification Search
USPC ..... 181/175
See application file for complete search history.

(56) References Cited

U.S. PATENT DOCUMENTS

| | | | | |
|---|---|---|---|---|
| 6,420,854 | B1 | 7/2002 | Hughes et al. | |
| 9,667,949 | B2 * | 5/2017 | Han | H04R 1/345 |
| 2007/0129902 | A1 | 6/2007 | Orbell | |
| 2011/0049312 | A1 | 3/2011 | Kato | |
| 2012/0068383 | A1 | 3/2012 | Sinha et al. | |
| 2013/0301983 | A1 * | 11/2013 | Mazumder | G02B 6/1226 385/16 |
| 2015/0070245 | A1 | 3/2015 | Han et al. | |
| 2015/0129351 | A1 * | 5/2015 | Wheeler | H04R 1/2853 181/152 |
| 2015/0228269 | A1 * | 8/2015 | Semperlotti | G10K 11/30 181/176 |

FOREIGN PATENT DOCUMENTS

| | | | |
|---|---|---|---|
| KR | 20100007674 | A | 1/2010 |
| KR | 20130105358 | A | 9/2013 |

OTHER PUBLICATIONS

Lee, Seung Hoo et al., "Switching terahertz waves with gate-controlled active graphene metamaterials", Nature Materials, Nov. 2012, pp. 936-941, vol. 11, 2012 Macmillan Publishers Limited.
Pendry, J.B., "Negative Refraction Makes a Perfect Lens", Physical Review Letters, Oct. 30, 2000, pp. 3966-3969, vol. 85, No. 18.
International Search Report dated Nov. 18, 2014 in International Application No. PCT/KR2014/006857, filed Jul. 28, 2014.

* cited by examiner

SOUND WAVE METAMATERIAL

RELATED APPLICATIONS

The present application is a National Phase of International Application Number PCT/KR2014/006857, filed Jul. 28, 2014, and claims priority from Korea Application Number 10-2014-0023953, filed Feb. 28, 2014.

BACKGROUND

1. Field of Disclosure

The present disclosure of invention relates to a sound wave metamaterial, and more specifically the present disclosure of invention relates to a sound wave metamaterial amplifying a sound wave using a resonance.

2. Description of Related Technology

Metamaterial is an imaginary material having a meta atom periodically arranged. Here, the meta atom is designed by a metal or a dielectric material having a small size much less than a wavelength. The metamaterial does not exist in the natural world, and is artificially made to have predetermined characteristics. For example, the metamaterial has a density higher than an air around the metamaterial but refracts a light to be far from a normal vector, which is called as negative refractive index. After Sir J. Pendry published a paper (PRL, 1999) in which a super lens may be realized by the material having the negative refractive index, the metamaterial is raised be one of the material to realize the invisible cloaking. Using transformation optics, the so-called invisible cloaking may be realized only theoretically, because 3-dimensional metamaterial is hard to be realized (until now 2-dimensional metamaterial is to be realized but having a very small size such as a several billion of the size of a postage stamp) and energy consumption of the metal is very high in a range of the visible wavelength. Until now, the invisible cloaking is experimentally realized in a range of the microwave (GHz).

An artificial atom (a meta atom) included in the metamaterial has predetermined characteristics in response to an electromagnetic wave or a sound wave applied to the metamaterial.

Accordingly, the metamaterial may be designed or composed to have arbitrary effective refractive index or an arbitrary effective material coefficient which does not exist in the natural world. Thus, the metamaterial causes new phenomena such as, a subwavelength focusing, a negative refraction, an extraordinary transmission and the invisible cloaking.

Nowadays, the studies are focused on fabricating various kinds of meta devices using the metamaterial or combining the metamaterial with various kinds of material like Graphene (Lee et al. Nature Materials, 2012), rather than imaging the wavelength using the metamaterial having the negative refractive index.

Korean laid-open patent application No. 10-2013-0105358 discloses a coil-based artificial atom of the metamaterial, the metamaterial having the same and a device having the same.

Prior art: Korean laid-open patent application No. 10-2013-0105358 (laid-open: Sep. 25, 2013.)

SUMMARY

The present invention is developed to solve the above-mentioned problems of the related arts. The present invention provides a sound wave metamaterial capable of amplifying a sound wave using a resonance.

According to an example embodiment, a sound wave metamaterial amplifies a sound wave, and includes a plate. The plate has a plurality of sound wave guides passing through both surfaces of the plate and having a predetermined pattern. The sound wave guides are spaced apart from each other by a predetermined distance and face each other, with respect to a central point, a central axis or a central surface.

In an example embodiment, the plate 100 may have a plate shape, and two plates may be spaced apart from each other by a predetermined distance and face each other.

In an example embodiment, the sound wave metamaterial may further include an enclosing part 200 enclosing all side surfaces of two plates 100.

In an example embodiment, the plate 100 may have a column shape having a predetermined space around a central axis of the plate.

In an example embodiment, the plate 100 may have a spherical shape having a predetermined space around a central point of the plate.

In an example embodiment, the sound wave guide 110 may be longer than a thickness of the plate 100.

In an example embodiment, the sound wave guide 110 may be one of a zigzag shape, a W shape, a S shape.

In an example embodiment, the plate 100 may have a material one of a metal, a stone, a wood, a glass, a ceramic and a plastic.

In an example embodiment, the sound wave metamaterial may further include a sound wave source 300 disposed in a space between the plates facing each other, the space around the central axis of the plate, or the space around the central point of the plate.

In an example embodiment, the sound wave metamaterial may further include a detector 400 disposed in a space between the plates facing each other, the space around the central axis of the plate, or the space around the central point of the plate.

According to the present example embodiments, a space limiting a sound wave is formed between the sound wave guides using the plates, and thus the sound wave having a frequency same as a resonance frequency of the plate may be effectively enhanced.

In addition, the space limiting the sound wave is formed and the enclosing part enclosing the space from outside is included, and thus a predetermined frequency of sound wave may be more effectively limited within the space.

In addition, when two plates are arranged in parallel by a predetermined distance, the sound wave may be amplified more efficiently along a direction perpendicular to a surface of the plate.

In addition, in the plate having the column shape, the sound wave perpendicular to the central axis of the plate may be amplified more efficiently.

In addition, in the plate having the spherical shape, the sound wave incident from all directions may be amplified more efficiently.

In addition, the sound wave guide is longer than the thickness of the plate, the plate may be manufactured with a relatively smaller size compared to the size required for the wavelength of the sound wave to be amplified.

In addition, an acoustic hard wall used for the acoustic may be used to manufacture the plate, and thus various kinds of materials may be used to manufacture the plate.

In addition, a sound wave source is included in the space limiting the sound wave (inside of the plate), and thus the sound wave emitted to outside may be amplified to be larger than that of the original sound wave.

In addition, a detector is included in the space limiting the sound wave (inside of the plate), and thus the sound wave incident from outside may be amplified to be larger than that of the original sound wave.

REFERENCE NUMERALS

Figure 1:
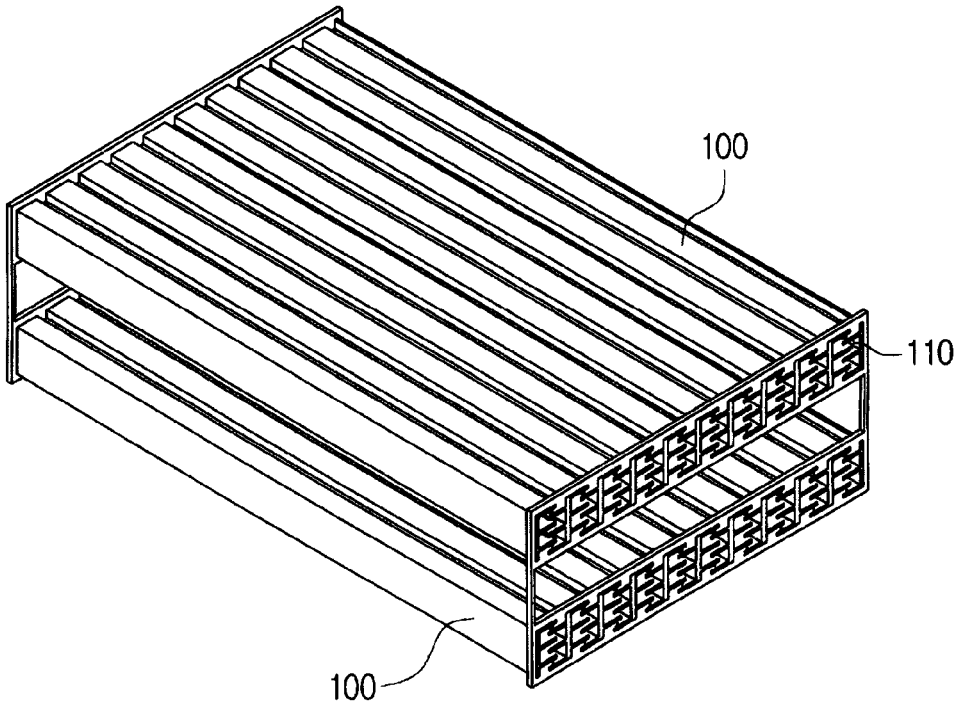
FIG. 1 is a perspective view illustrating a sound metamaterial having a plain shape according to an example embodiment of the present invention.

10: sound wave source
20: detector
100: plate
110: sound wave guide

DETAILED DESCRIPTION

The invention is described more fully hereinafter with Reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. Hereinafter, exemplary embodiment of the invention will be explained in detail with reference to the accompanying drawings.

Figure 2:
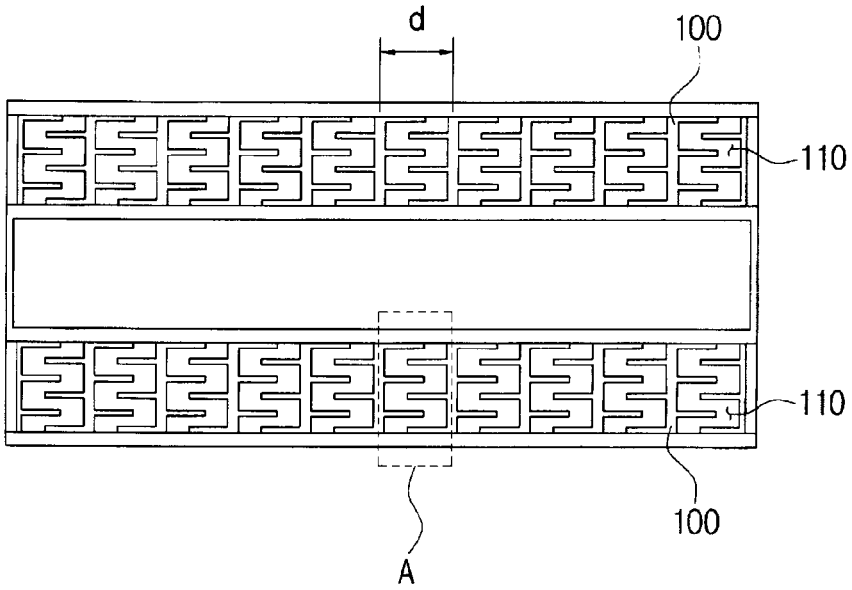
FIG. 2 is a front view illustrating the sound metamaterial in FIG. 1.
Figure 3:
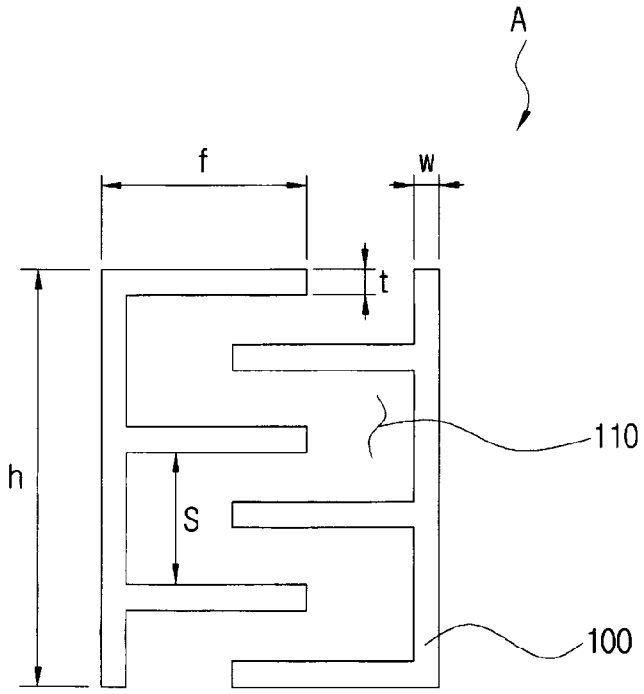
FIG. 3 is an enlarged view of a portion 'A' in FIG. 2.
Figure 4:
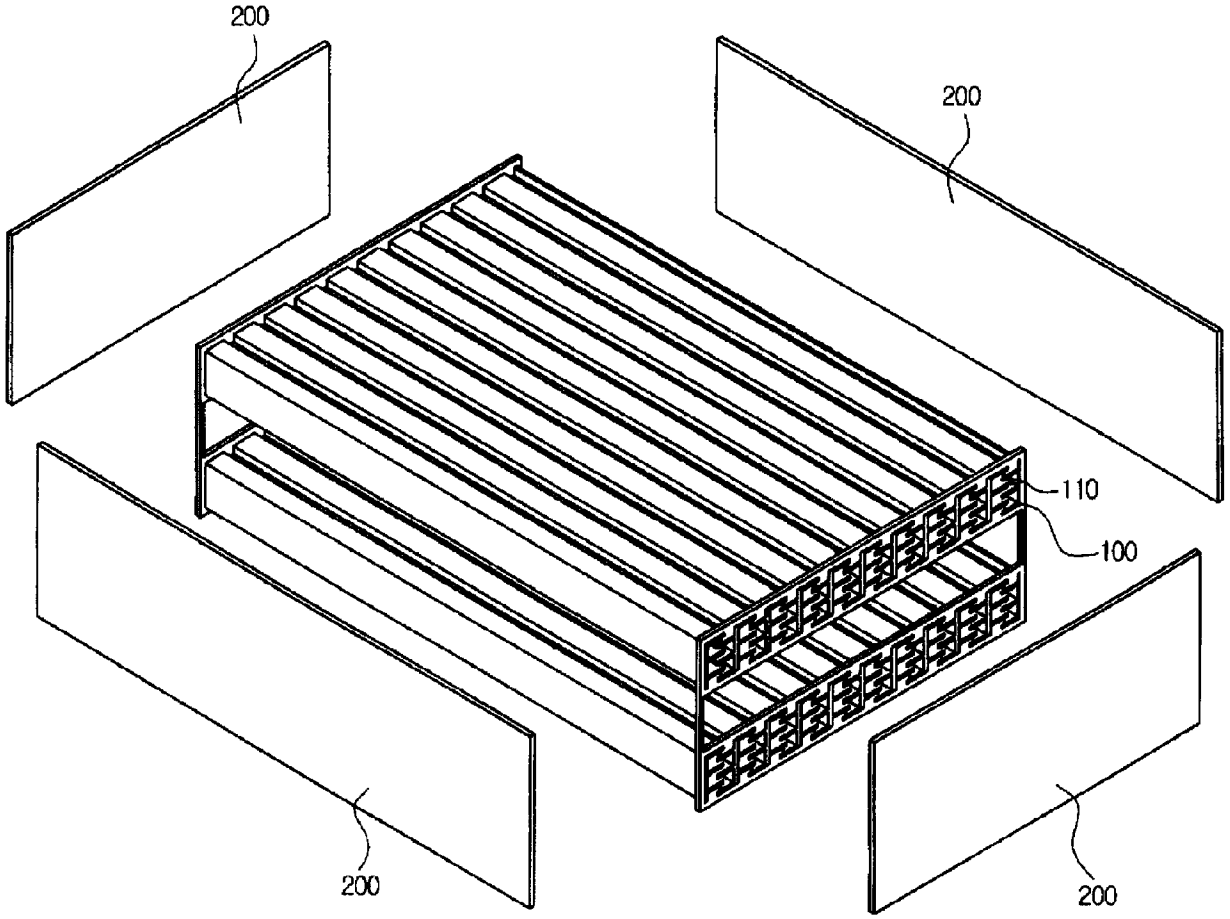
FIG. 4 is an exploded perspective view illustrating an enclosing part added to the sound metamaterial in FIG. 1.
Figure 5:
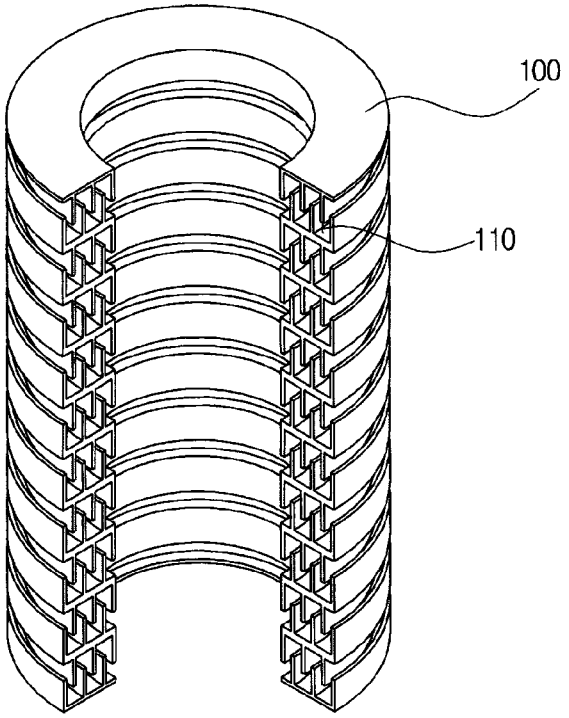
FIG. 5 is a conceptual view illustrating a sound metamaterial having a column shape according to another example embodiment of the present invention.
Figure 6:
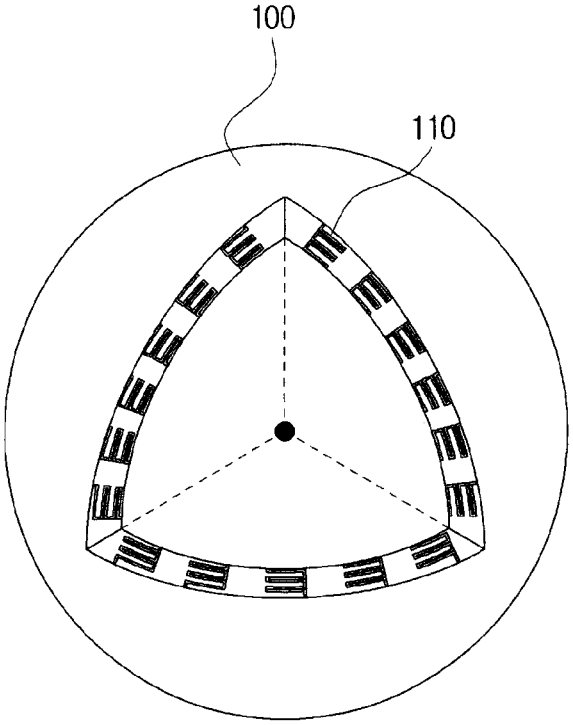
FIG. 6 is a conceptual view illustrating a sound metamaterial having a spherical shape according to still another example embodiment of the present invention.
Figure 7:
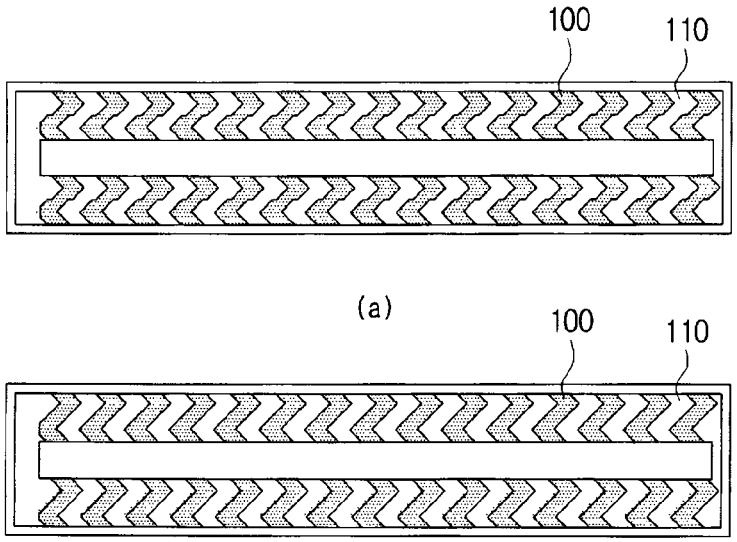
FIG. 7, views (a) and (b), and FIG. 8, views (a) and (b), are conceptual views illustrating a sound wave guide of the metamaterial of FIGS. 1, 5 and 6.
Figure 9:
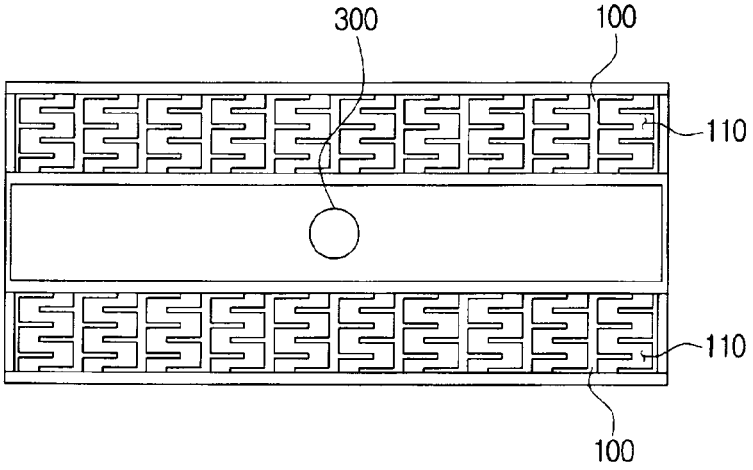
FIG. 9 is a conceptual view illustrating a sound metamaterial having a sound wave source according to still another example embodiment of the present invention.
Figure 10:
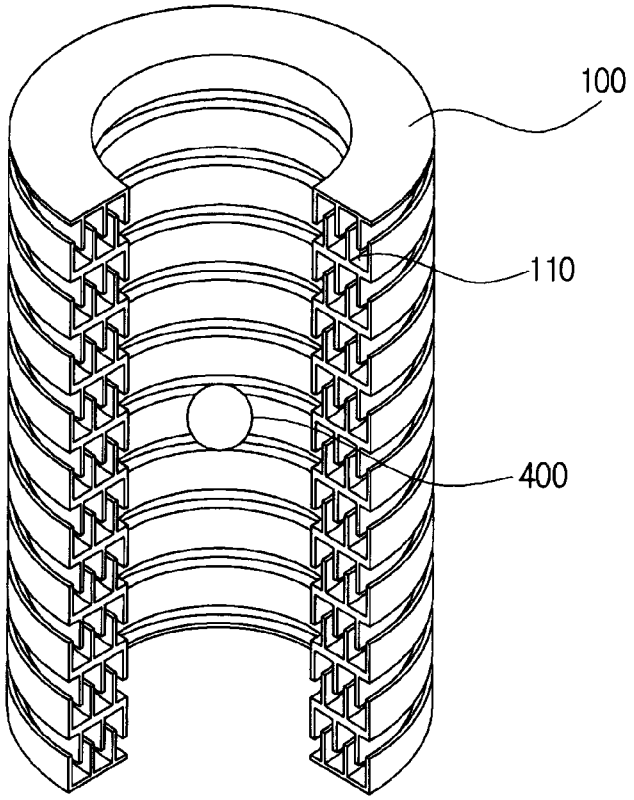
FIG. 10 is a conceptual view illustrating a sound metamaterial having a detector according to still another example embodiment of the present invention.

FIG. 1 is a perspective view illustrating a sound metamaterial having a plain shape according to an example embodiment of the present invention. FIG. 2 is a front view illustrating the sound metamaterial in FIG. 1. FIG. 3 is an enlarged view of a portion 'A' in FIG. 2. FIG. 4 is an exploded perspective view illustrating an enclosing part added to the sound metamaterial in FIG. 1. FIG. 5 is a conceptual view illustrating a sound metamaterial having a column shape according to another example embodiment of the present invention. FIG. 6 is a conceptual view illustrating a sound metamaterial having a spherical shape according to still another example embodiment of the present invention. FIG. 7, views (a) and (b), and FIG. 8, views (a) and (b), are conceptual views illustrating a sound wave guide of the metamaterial of FIGS. 1, 5 and 6. FIG. 9 is a conceptual view illustrating a sound metamaterial having a sound wave source according to still another example embodiment of the present invention. FIG. 10 is a conceptual view illustrating a sound metamaterial having a detector according to still another example embodiment of the present invention.

When a vibration of an object disturbs air particles moving arbitrarily, a relatively high pressure zone and a relatively low pressure zone appear. Then, the air particles move from the relatively high pressure zone to the relatively low pressure zone and thus a sound wave spreads. Finally, the variation of the pressure of the air reaches to ears of human beings and vibrates the tympanic membrane.

An audio frequency for the human begins is in a range of about 20~20,000 Hz. The sound wave less than 20 Hz is called as the infrasonic wave, and the sound wave more than 20,000 Hz is called as an ultrasonic wave.

The metamaterial according to the present example embodiment is explained as follows.

In the metamaterial amplifying the sound wave, the metamaterial includes a plate 100 having a plurality of sound wave guides 110 passing through both surfaces of the plate and having a predetermined pattern. The sound wave guides 110 are spaced apart from each other by a predetermined distance and face each other, with respect to a central point, a central axis or a central surface. Here, the sound wave guide 110 is a pathway through which the sound wave passes.

A resonance is defined as such an amplitude of the object having a predetermined frequency is increased when a force having the same frequency is applied from outside so that the energy is increased. When the frequency of the sound wave is same as the resonance frequency of the plate (structure) and the sound wave is continuously generated from the sound source, the sound wave of high intensity having the resonance frequency is limited inside if the plate, and thus the sound wave may be amplified.

Accordingly, in the metamaterial of the present example embodiment, the space limiting the sound wave is formed between the sound wave guides using the plate having the sound wave guide facing each other, and thus the sound wave having the frequency same as the resonance frequency of the plate may be amplified.

First, the plate 100 is explained.

As illustrated in FIG. 1, the plate 100 of the sound wave metamaterial has a plate shape, and two plates are disposed in parallel by a predetermined distance and face each other.

The plate having the plate shape and two plates are disposed in parallel such that the sound wave may be easily limited in a space using the resonance of the plates, and thus the sound wave having the frequency same as the resonance frequency of the plate is limited in the space between the plates facing each other.

Here, the plates are guided by a guide (not shown) to be disposed in parallel by the predetermined distance.

In the metamaterial having the plates facing each other and disposed in parallel by the predetermined distance, the sound wave spreading along a direction substantially perpendicular to the surface of the plate 100 is amplified most. For example, the surface of the plate 100 is arranged substantially perpendicular to the direction in which the sound wave advance. Thus, the metamaterial may be used to emit the sound wave to a predetermined direction, or to detect the sound wave advancing or emitting along a predetermined direction.

The resonance frequency of the plate depends on all factors forming the sound wave guide (for example, all factors w, t, f, h, s in FIG. 3) and all factors forming the space limiting the sound wave.

For example, the resonance frequency due to Fabry-Perot Resonance may be determined $$t = \frac{4Z_1 Z_{eff}}{[Z_1 + Z_{eff}][Z_{eff} + Z_1]e^{-jn_{eff}kh} + [Z_1 - Z_{eff}][Z_{eff} - Z_1]e^{jn_{eff}kh}}$$

$$r = \frac{[Z_1 + Z_{eff}][Z_{eff} + Z_1]e^{-jn_{eff}kh} + [Z_1 - Z_{eff}][Z_{eff} + Z_1]e^{jn_{eff}kh}}{[Z_1 + Z_{eff}][Z_{eff} + Z_1]e^{-jn_{eff}kh} + [Z_1 - Z_{eff}][Z_{eff} - Z_1]e^{jn_{eff}kh}}$$

(Here, t is a transmission coefficient, r is a reflection coefficient, $Z_1$ is an impedance of air, $Z_{eff}$ is an impedance of metamaterial, k is a wave number (inverse number of wavelength) in a fluid, h is a thickness of the plate, and $n_{eff}$ is refractive index of metamaterial guide.)

by the above equation.

In the resonance frequency, t (transmission coefficient) is 1 and r (reflection coefficient) is 0.

As illustrated in FIG. 4, the sound wave metamaterial is explained as followed.

The metamaterial may further include an enclosing part 200 enclosing all side surfaces of two plates 100.

The plate should be enclosed from outside, to limit the sound wave having a predetermined frequency within the space between the pates. Thus, the side surfaces of two plates 100, which is the space limiting the sound wave, should be enclosed.

As illustrated in FIG. 5, the sound wave metamaterial according to the present example embodiment has a plate 100 with a column shape. The plate 100 has a space by a predetermined area with respect to a central axis (longitudinal direction) of the plate 100. For example, the column shape may be a circular cylinder or a poly-prism like triangular prism, a quadrangular prism, a pentagonal prism, a hexagonal prism and so on. Thus, the plate having the column shape has the space inside of the column in which the sound wave is limited. In addition, both sides of the plate 100 may be enclosed, to limit the sound wave having a specific frequency inside of the space between the plates.

As illustrated in FIG. 6, the sound wave metamaterial according to the present example embodiment has a plate 100 with a spherical shape. The plate 100 has a space by a predetermined area with respect to a central point of the plate 100. For example, the plate having the spherical shape has the space inside of the sphere in which the sound wave is limited.

The sound wave guide 110 is longer than a thickness of the plate 100. For example, the sound wave guide 110 may have various kinds of shape to meet the condition that a length of the sound wave guide is longer than the thickness of the plate 100, so that the sound wave may be delayed inside of the sound wave guide 110.

Figure 8:
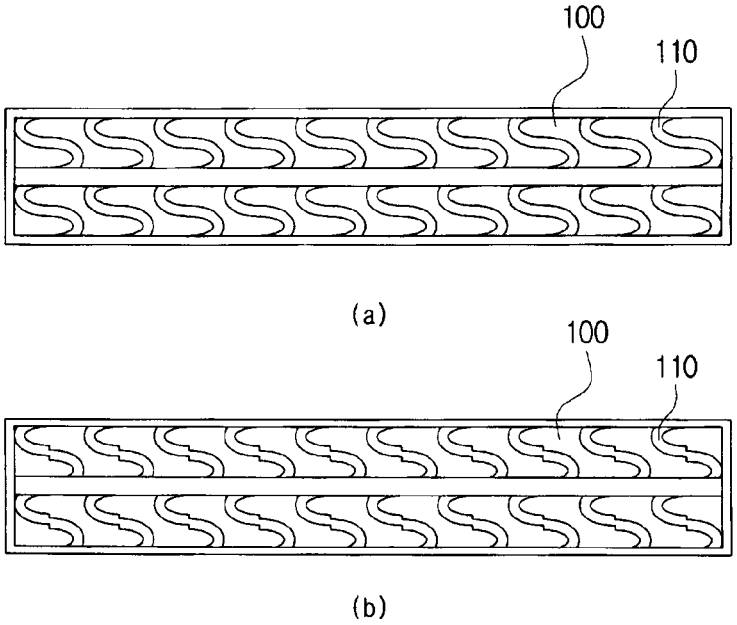

For example, as illustrated in FIG. 2, FIG. 7, views (a) and (b), and FIG. 8, views (a) and (b), the wherein the sound wave guide 110 is one of a zigzag shape, a W shape, a S shape, to increase the length of the sound wave guide 110.

The plate 100 may include a material as follows.

For example, the plate 100 has a material one of a metal, a stone, a wood, a glass, a ceramic and a plastic.

Here, the metal may be metal steel like carbon steel, alloy steel, cast iron, or a nonferrous metal like copper, copper alloy (brass, bronze), aluminum, aluminum alloy, manganese.

A material of the plate 100 may not be limited to the above, and the plate 100 may include the material having an acoustic hard wall with transmissivity of less than 10% for the sound wave.

As illustrated in FIG. 9, the sound wave metamaterial according to the present example embodiment may further include a sound wave source 300 disposed in a space between the plates facing each other, the space around the central axis of the plate, or the space around the central point of the plate.

The sound wave source 300 is all kinds of devices generating the sound wave, like a speaker, an infrasonic wave generator, an ultrasonic wave generator and so on.

When the sound wave source 300 is disposed at the space in which the sound wave is limited, the sound wave having the specific frequency same as the resonance frequency of the plate is amplified in the space in which the sound wave is limited and is spread to outside, and thus the specific frequency may be amplified and outputted more effectively.

The sound wave source 300 is generally connected to a wire (signal line). Thus, a through hole is formed through the enclosing part 200 or the plate 100 to pass through the plate 100 and the sound wave source 300 is connected to the wire through the through hole, when the sound wave source 300 is disposed in the space in which the sound wave is limited and the space limiting the sound wave is enclosed from the outside of the plate. Further, after the sound wave source 300 is connected to the wire, the through hole should be blocked.

As illustrated in FIG. 10, the sound wave metamaterial according to the present example embodiment may further include a detector 400 disposed in a space between the plates facing each other, the space around the central axis of the plate, or the space around the central point of the plate.

The detector 400 is all kinds of devices sensing or detecting the sound wave, like a sound pressure sensor, a sound wave sensor, a sound navigation and ranging (SONAR), an ultrasonic sensor.

When the detector 400 is disposed in the space limiting the sound wave, the specific frequency same as the resonance frequency of the plate is amplified in the space in which the sound wave is limited and is detected by the detector 400, and thus the specific frequency may be amplified and inputted more effectively.

The detector 400 is generally connected to a wire (signal line). Thus, a through hole is formed through the enclosing part 200 or the plate 100 to pass through the plate 100 and the detector 400 is connected to the wire through the through hole, when the detector 400 is disposed in the space in which the sound wave is limited and the space limiting the sound wave is enclosed from the outside of the plate. Further, after the detector 400 is connected to the wire, the through hole should be blocked.

The sound wave metamaterial according to the present example embodiments may be used in all kinds of circumstances like in ambient air, in underwater and so on, in which the sound wave is transmitted. In addition, the sound wave metamaterial according to the present example embodiments may be applied all kinds of fields using the sound wave like sound wave sensing (acoustic sensing), acoustic device, ultrasonic imaging, nondestructive inspection and so on.

Having described the example embodiments of the present invention and its advantage, it is noted that various changes, substitutions and alterations can be made herein without departing from the spirit and scope of the invention as defined by appended claims.

What is claimed is:

1. A sound wave metamaterial configured to amplify a sound wave, the sound wave metamaterial comprising:

a plurality of plates, each of the plates having a predetermined thickness and an upper surface and a lower surface, a plurality of sound wave guides being formed between the upper and lower surfaces of the plate, wherein each of the sound wave guides passes through the upper and lower surfaces of the corresponding plate and has a predetermined pattern, the sound wave guides adjacent to each other are spaced apart from each other along an extending direction of the upper and lower surfaces of the plate, and the plates adjacent to each other are spaced apart from each other to form a space in which the sound wave guides are not disposed.

2. The sound wave metamaterial of claim 1, wherein each of the plates has a rectangular plate shape, and the plates adjacent to each other are spaced apart from each other by a predetermined distance to form the space between the plates.

3. The sound wave metamaterial of claim 2, further comprising:

an enclosing part enclosing (i) all side surfaces of the plates adjacent to each other and (ii) the space between the plates adjacent to each other.

4. The sound wave metamaterial of claim 1, wherein each of the plates has a column shape with the predetermined thickness, and the sound wave guides are formed inside the column shape.

5. The sound wave metamaterial of claim 1, wherein each of the plates has a circular shape with the predetermined thickness and a predetermined width, in each of the plates, the circular shape has an open central portion, and the plates are stacked vertically to cause the open central portions of the plates to form a cylindrical shape.

6. The sound wave metamaterial of claim 1, wherein a total length of a single sound wave guide among the plurality of sound waive guides is greater than the predetermined thickness of a single plate among the plurality of plates.

7. The sound wave metamaterial of claim 6, wherein each of the sound wave guides is one of a zigzag shape, a W shape, or a S shape.

8. The sound wave metamaterial of claim 1, wherein the plate has a material including one of metal, stone, wood, glass, ceramic, or plastic.

9. The sound wave metamaterial of claim 1, further comprising:

a sound wave source disposed in the space between the plates adjacent to each other.

10. The sound wave metamaterial of claim 1, further comprising:

a detector disposed in the space between the plates adjacent to each other.

* * * * *